US006295964B1

(12) United States Patent
DiMaria et al.

(10) Patent No.: US 6,295,964 B1
(45) Date of Patent: Oct. 2, 2001

(54) END-FEED VARIABLE CAM TIMING OIL SUPPLY AND CONTROL MODULE

(75) Inventors: Anthony Frank DiMaria, Canton; Jeffrey Allen Mullins, Allen Park; John Paul Vivier, Livonia; Mark Allen Bourcier, Plymouth, all of MI (US)

(73) Assignee: Ford Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/636,538

(22) Filed: Aug. 10, 2000

(51) Int. Cl.[7] ..... F01M 1/00
(52) U.S. Cl. ..... 123/196 R; 123/90.15
(58) Field of Search ..... 123/196 R, 90.15, 123/90.31

(56) References Cited

U.S. PATENT DOCUMENTS

| | | |
|---|---|---|
| 4,607,601 | 8/1986 | Kohler . |
| 4,823,767 | 4/1989 | Wagner et al. . |
| 4,862,843 | 9/1989 | Kawamoto et al. . |
| 5,002,023 | 3/1991 | Butterfield et al. . |
| 5,040,651 | 8/1991 | Hampton et al. . |
| 5,046,460 | 9/1991 | Butterfield et al. . |
| 5,052,351 | 10/1991 | Nishimura et al. . |
| 5,095,857 | 3/1992 | Hampton et al. . |
| 5,107,804 | 4/1992 | Becker et al. . |
| 5,117,784 | 6/1992 | Schechter et al. . |
| 5,119,691 | 6/1992 | Lichti et al. . |
| 5,163,872 | 11/1992 | Niemeic et al. . |
| 5,172,661 | 12/1992 | Brune et al. . |
| 5,209,202 | 5/1993 | Maurer et al. . |
| 5,216,984 | 6/1993 | Shimano et al. . |
| 5,245,968 | 9/1993 | Kolias et al. . |
| 5,327,859 | 7/1994 | Pierik et al. . |
| 5,357,932 | 10/1994 | Clinton et al. . |
| 5,363,817 | 11/1994 | Ikeda et al. . |
| 5,366,418 | 11/1994 | Fukushima et al. . |
| 5,447,126 | 9/1995 | Kondoh et al. . |
| 5,540,197 | 7/1996 | Golovatai-Schmidt et al. . |
| 5,548,995 | 8/1996 | Clinton et al. . |
| 5,609,126 | 3/1997 | Cullen et al. . |
| 5,657,725 | 8/1997 | Butterfield et al. . |
| 5,666,914 | 9/1997 | Ushida et al. . |
| 5,666,915 | 9/1997 | Kawashima et al. . |
| 5,680,834 | 10/1997 | Szpak et al. . |
| 5,715,780 | 2/1998 | Haller . |
| 5,755,202 | 5/1998 | Stefanopoulou et al. . |
| 5,803,030 | 9/1998 | Cole . |
| 5,836,278 | 11/1998 | Scheidt . |

FOREIGN PATENT DOCUMENTS

| | | |
|---|---|---|
| 63-186906 | 2/1988 | (JP) . |
| 4-140458 | 5/1992 | (JP) . |

*Primary Examiner*—Noah P. Kamen
(74) *Attorney, Agent, or Firm*—Jerome R. Drouillard

(57) ABSTRACT

A system for controlling a flow of pressurized oil in an internal combustion engine includes a cylinder head having a first internal passage arranged to receive a supply of pressurized oil from the engine, wherein the first internal passage includes a flow restrictor; and a second internal passage connecting a section of the first internal passage upstream of the restrictor with a port formed in an external surface of the cylinder head to thereby define a pressurized oil outlet. The system further includes an oil flow control module including a pressurized oil inlet defined in a first surface thereof, and a spool valve operative to direct unrestricted oil flowing through the second passage within the cylinder head into one of a plurality of fluid lines operatively connected to the cam phaser unit, whereupon the spool valve is used to variably advance or retard engine cam timing.

17 Claims, 4 Drawing Sheets

Fig. 3
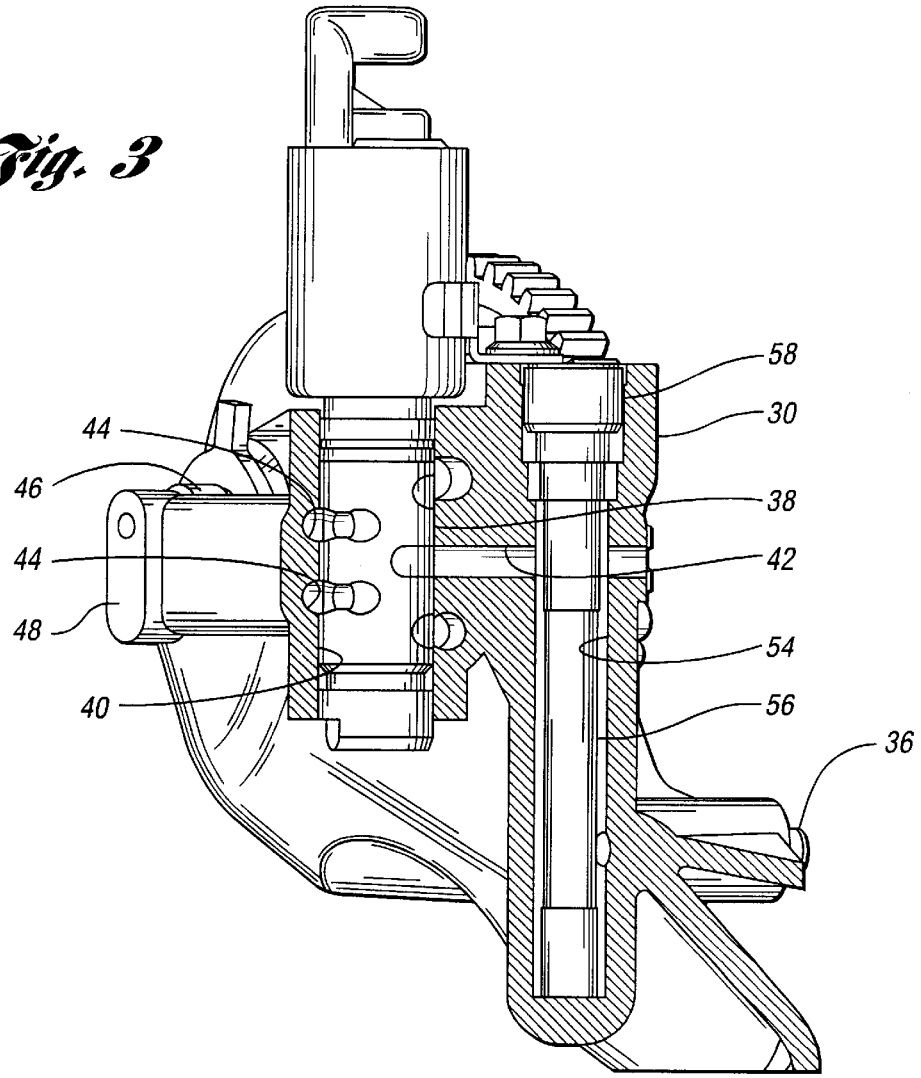
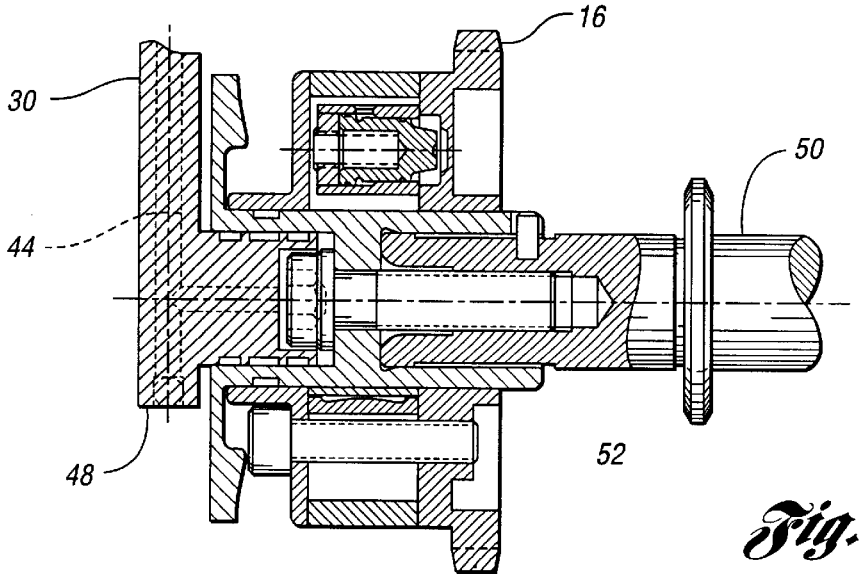
Fig. 4

END-FEED VARIABLE CAM TIMING OIL SUPPLY AND CONTROL MODULE

BACKGROUND OF THE INVENTION

1. Field of the Invention

The invention relates to internal combustion engines which include variable cam timing systems, wherein a pressurized flow of valvetrain-lubricating oil to the cylinder head is controllably diverted to operate a cam phaser unit, for example, mounted on an end of a cam shaft.

2. Background Art

The prior art teaches internal combustion engines wherein a fixed relationship between camshaft rotation and crankshaft rotation is maintained to thereby preserve the relationship between intake and exhaust valve events and piston motion. Alternatively, the prior art teaches so-called variable cam timing engines which seek to adjust this relationship to achieve such advantages as increased fuel economy and reduced regulated emissions. Under one prior art approach, as disclosed in U.S. Pat. No. 5,363,817, actual cam timing is measured using a toothed wheel on the camshaft and a toothed wheel on the crankshaft. The time, or angle, between receiving pulses from the wheel on the crankshaft and the wheel on the camshaft represents the actual cam timing. A desired cam timing is determined as a function of engine operating conditions, and an error signal is created from the difference of the desired cam timing and the actual cam timing. Control signals based upon the error signal are then generated and supplied to actuators capable of adjusting the cam timing, typically by supplying pressurized oil to a solenoid valve that controllably diverts the pressurized oil to a selected passage in the camshaft which, in turn, directs the pressurized oil to an oil-pressure-responsive cam phaser unit.

Significantly, in such a system, the cylinder heads are specifically designed for variable cam timing, i.e., the heads include oil-porting passages to communicate pressurized oil to "advance" and "retard" passages defined in the camshaft. Such systems thus require extensive design considerations and machining of the heads and camshaft to accommodate the oil passages, as well as consideration to the mounting of the solenoid valves.

Alternatively, the prior art teaches use of ported camshaft bearings to define the paths by which pressurized oil is supplied to a camshaft-mounted cam phaser unit. Such ported camshaft bearings either require similar oil-porting passages in the cylinder head, or external oil routing tubes and flow control structures which, in turn, present additional packaging and mechanical attachment issues, each serving to increase the cost of providing variable cam timing to an existing engine. Such external oil routing tubes and flow control structures also constitute additional parts to be installed or assembled to the engine, thereby serving to further increase engine assembly space and manpower requirements.

SUMMARY OF THE INVENTION

It is an object of the invention to provide simplified oil supply and control system for a variable cam timing system of an internal combustion engine and, particularly, a system for controlling such oil flow by which given engine architectures are provided with variable cam timing with fewer modifications to such major engine components as the cylinder head and cylinder block, and with a reduced part count and simplified engine assembly.

Under the invention, a system is provided for controlling a flow of pressurized oil within an internal combustion engine, wherein the system includes a cylinder head that receives a supply of pressurized oil from, for example, an oil pump incorporated into an engine block. The cylinder head itself includes a first internal passage that receives the pressurized oil flow, wherein the first passage includes a flow restrictor at a first location therealong; and an oil outlet defined in a first external surface of the cylinder head, the oil outlet being in fluid communication with a first section of the first passage upstream of the flow restrictor. In this manner, a first portion of the pressurized oil flow received by the cylinder head is diverted, i.e., is urged to flow, through the oil outlet in the cylinder head. While the flow restrictor in the cylinder head is of any suitable construction, in an exemplary embodiment, the flow restrictor is defined by a reduced-hydraulic-diameter section of the first passage.

The system further includes an oil flow control module secured to the cylinder head and, preferably, also secured to the engine block. The oil flow control module has an inlet passage defined in a first exterior surface that is secured against the first external surface of the cylinder head, such that the oil inlet of the oil flow control module receives the diverted first portion of the pressurized oil flow from the cylinder head. The oil flow control module also includes a plurality of outlet passages defined therein, and a control valve, for example, a spool valve, in fluid communication with the inlet passage and the outlet passages that is operative to further divert the first portion of the pressurized oil flow into a selected one of the outlet passages.

In accordance with another feature of the invention, while the oil flow control module is positioned and secured to the engine in any suitable manner, a preferred embodiment includes a tubular dowel received in both the oil outlet of the cylinder head and the oil inlet of the module. In this manner, the oil outlet of the cylinder head advantageously serves to accurately locate the module on the cylinder head, thereby obviating the need for both additional machining of the cylinder head and the additional operation of installing a fastener or locating pin in any such additional bore.

In accordance with another feature of the invention, the system further includes a filter operative to remove particulate from the first portion of the received flow that is diverted through the oil outlet of the cylinder head into the inlet passage of the oil flow control module. In a first exemplary embodiment, a cavity is defined within the oil flow control module that intersects the module's inlet passage, and a filter element, for example, a radial-flow screen filter, is disposed within the cavity such that the filter element removes particulate from the oil flow diverted into the module before the oil flow reaches the spool valve. In a second exemplary embodiment, the filter is disposed in the first passage of the cylinder head upstream of the flow restrictor and, preferably, is a radial-flow filter to render the filter media "self-cleaning."

In accordance with yet another feature of the invention, the oil flow control module preferably includes a second external surface that performs the function of another engine-mounted component, thereby obviating the need for installing the other engine-mounted component. Thus, by way of example only, the module of an exemplary system includes a second exterior surface that itself defines at least a portion of a timing chain guide.

Where the system is used to provide pressurized oil feeds to a cam phaser unit mounted on an end of a cam shaft, the oil flow control module advantageously includes a cylindrical projection that is generally collinear with the cam shaft and that is arranged to be received directly within a complementary bore of the cam phaser unit. The cylindrical projection of the oil flow control module includes a plurality of oil ports defined therein, each oil port being in fluid communication with a respective one of the outlet passages in the module.

Other objects, features and advantages of the present invention are readily apparent from the following detailed description when taken in connection with the accompanying drawings.

BRIEF DESCRIPTION OF THE DRAWINGS

FIG. 3 is a partial cross-sectional view of the front end of the left-hand cylinder head oil flow control module showing the cylinder head's internal passage, downstream flow restrictor and upstream oil outlet, along with the oil flow control module's oil inlet and inlet passage;

FIG. 4 is a vertical cross-sectional view of the left-hand oil flow control module and associated cam phaser unit taken along the axis of the camshaft;

DETAILED DESCRIPTION OF THE PREFERRED EMBODIMENTS

Figure 1:
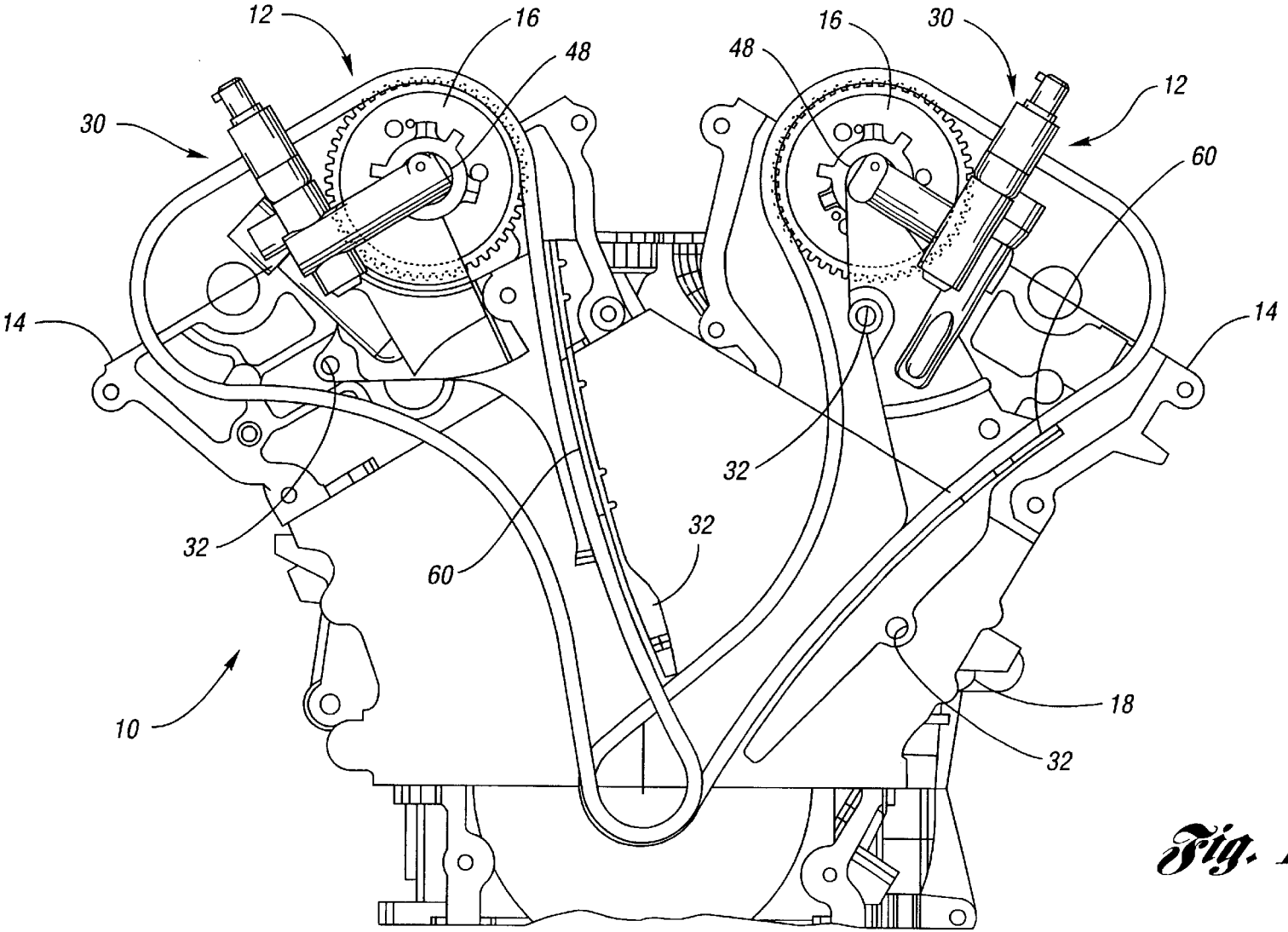
FIG. 1 is a front-end view of a partially-assembled "V"-configuration internal combustion engine featuring a first exemplary system for controlling a flow of pressurized oil to each cylinder head and a hydraulically-responsive cam phaser unit (with the timing sprocket for the exhaust valve camshaft removed for clarity of illustration)
Figure 2:
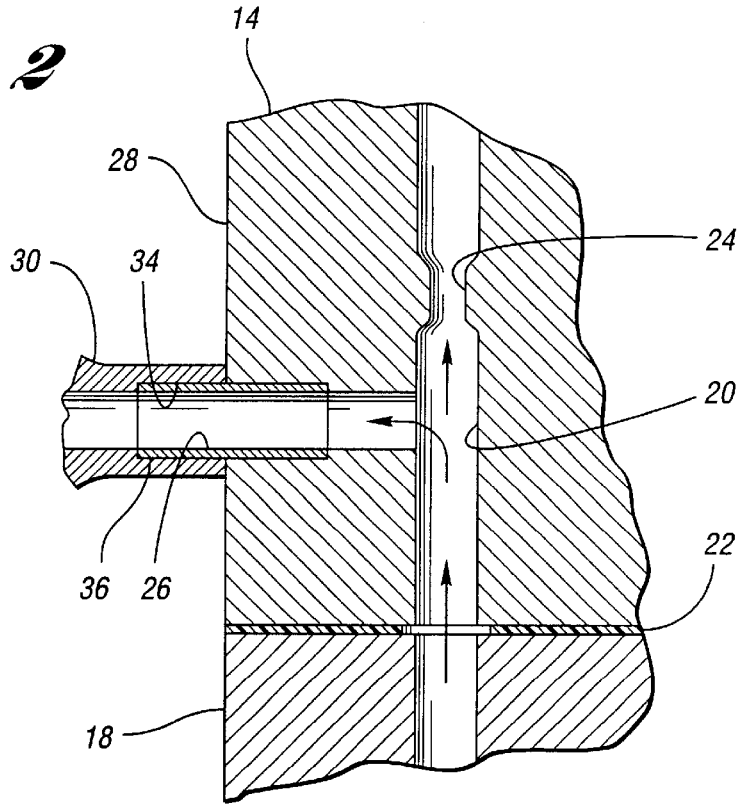
FIG. 2 is a partial view of the left-hand oil flow control module and associated cam phaser unit, wherein portions of the module are partially broken away to illustrate the module's inlet passage, filter cavity, filter, and spool valve.

Referring to the Drawings, wherein like elements are designated using like reference numerals in each of the several views, FIG. 1 is a front-end view of a partially-assembled "V"-configuration internal combustion engine 10 incorporating an exemplary system 12 for controlling a flow of pressurized oil to each of the engine's cylinder heads 14 such that a first portion of the pressurized oil flow is controllably diverted to operate a hydraulically-responsive cam phaser unit 16 supported on the end of each intake-valve camshaft (not shown). More specifically, the engine 10 includes a cylinder block 18 incorporating an oil pump (not shown) for generating a flow of pressurized, engine-lubricating oil. As illustrated in FIG. 2 in the context of the left-hand cylinder head 14, the pressurized oil flow is directed upwardly in the cylinder block 18 into an internal passage 20 defined within each of the engine's cylinder heads 14 for purposes of lubricating the engine's valve train (not shown). A cylinder head gasket 22 disposed between the cylinder block 18 and each cylinder head 14 serves to prevent leaking but, in accordance with another feature of the invention, does not itself operate to restrict pressurized oil flow from the cylinder block 18 into the cylinder head 14.

Also as seen in FIG. 2, the cylinder head includes an oil flow restrictor 24 within the cylinder head's oil-receiving passage 20. While the invention contemplates providing a flow restrictor 24 in the passage in any appropriate manner, in the first exemplary embodiment, a section of the passage 20 is formed with a relatively-reduced hydraulic diameter to thereby conveniently define the flow restrictor 24 within the cylinder head 14. The placement of the flow restrictor 24 in the cylinder head advantageously obviates the need to provide such a restrictor elsewhere, for example, in the cylinder head gasket 22.

An oil outlet 26 is defined in the front external surface 28 of each cylinder head 14. The oil outlet 26 is in fluid communication with the cylinder head's oil-receiving passage 20 at a point upstream of the flow restrictor 24, such that a portion of the pressurized oil flow received by the cylinder head 14 is ported externally of the cylinder head 14 through the oil outlet 26. While the invention contemplates placement of the oil outlet 26 at any suitable location, in the first exemplary system 12 illustrated in the Figures, the oil outlet 26 is preferably placed as close to the engine's oil pump as possible.

As best seen in FIG. 1, the exemplary system 12 also includes an oil flow control module 30 secured both to its respective cylinder head 14 as well as to the cylinder block 18, as described more fully below. While the invention contemplates any suitable manner of attaching or securing each module 30 to its respective cylinder head 14 and the cylinder block 18, in the exemplary system 12, each module 30 is attached to its respective cylinder head 14 at a plurality of attachment points 32 on the engine 10 as with threaded fasteners (not shown). The module 30 itself is advantageously formed of a die-cast aluminum or through use of powdered metallurgy, whereby the machining expense otherwise associated with providing an engine with variable cam timing is significantly reduced.

Returning to FIGS. 2–4, the oil flow control module 30 includes an oil inlet 34 defined in the module's back side 36. The oil outlet 26 of the cylinder head 14 and the oil inlet 34 of the oil flow control module 30 cooperate to align the module 30 on the cylinder head 14. By way of example only, where the oil outlet 26 and the oil inlet 34 are respectively formed as generally cylindrical bores, a tubular dowel 36 received in both the oil outlet 26 and the oil inlet 34 permits oil flow therebetween while advantageously further serving to locate and maintain the alignment of the module 30 relative to the cylinder head 14. It will be appreciated that the use of the tubular dowel 36 advantageously serves to obviate the need for both additional machining of the cylinder head and the additional operation of installing a fastener or locating pin in any such additional bore.

As best seen in FIGS. 3 and 4, each oil flow control module 30 also includes an oil control valve, such as a solenoid-operated spool value 38, received in a first cavity 40 defined within the module 30 in fluid communication with the module's oil inlet 34 via an inlet passage 42. The spool valve 38 is operative to redirect the externally-ported oil flow from the cylinder head 14 into one of a plurality of outlet passages 44 that are also defined in the module 30. The outlet passages 44 themselves lead to the cam phaser unit 16, for example, as through the use of a cylindrical projection 46 defined on one end 48 of the module 30. The cam phaser unit 16 is secured to an end of its respective camshaft 50 for rotation therewith, as with a fastener 52. It is noted that the diversion by the spool valve 38 of unrestricted oil flow from the cylinder head 14 advantageously provides a substantially continuous supply of oil to the cam phaser unit 16, even at relatively-low engine rpm, for example, when idling with a hot engine (with relatively thin oil).

As best seen in FIG. 3, and in accordance with another feature of the invention, the module 30 of the first exemplary system 10 also includes a second bore or cavity 54 intersecting the inlet passage 42 upstream of the spool valve 38. The second cavity 54 houses a filter element, for example, a radial-flow screen filter 56, such that the spool valve 38 receives only filtered oil, to thereby advantageously prolong the life of the variable cam timing system. A removable plug 58 conveniently seals the upper end of the second cavity, further facilitating assembly of the module 30.

In accordance with another feature of the invention, the first exemplary system 12 advantageously allows for the combination of the oil flow control module 30 with another exterior structure of the engine 10, resulting both in reduced production and assembly costs and, particularly, reducing the amount of secondary machining on the cylinder head 14. Thus, as best seen in FIG. 1, the module 30 includes a surface 60 that defines a timing chain guide for use with the module's respective camshaft, with the module 30 itself being advantageously secured to both the cylinder head 14 and the cylinder block 18 at the nominal attachment points 32 thereon previously used for attaching a chain guide to the engine 10. Of course, it will be appreciated that the surface 60 can be provided with any suitable properties, by way of example only, in the exemplary embodiment, the module includes a wear strip formed of a suitable material, such as 6/6 Nylon to define the second external surface. The "snap-in" nylon wear strip is conveniently placed in interference fit within a complementary channel defined in the module 30.

In this manner, the invention advantageously simplifies engine assembly, with an attendant reduction in both part count and, perhaps most significantly, obviates the need for machining additional attachment points on the engine when the engine is to be outfitted with variable cam timing. Moreover, the invention advantageously provides certain necessary components of a variable cam timing system in a single package while further eliminating the extra machining operations on the cylinder head 14 that are typical of prior art systems, e.g., to accommodate the spool valve 38 and associated pressurized oil circuits 42, 44. Indeed, it will be appreciated that a variable-cost savings is readily achieved under the invention because component assembly operations are minimized, and because machined surfaces that are typically in the cylinder head 14 are instead obtained on the much smaller oil flow control module 30, with faster manufacturing cycle times.

Figure 5:
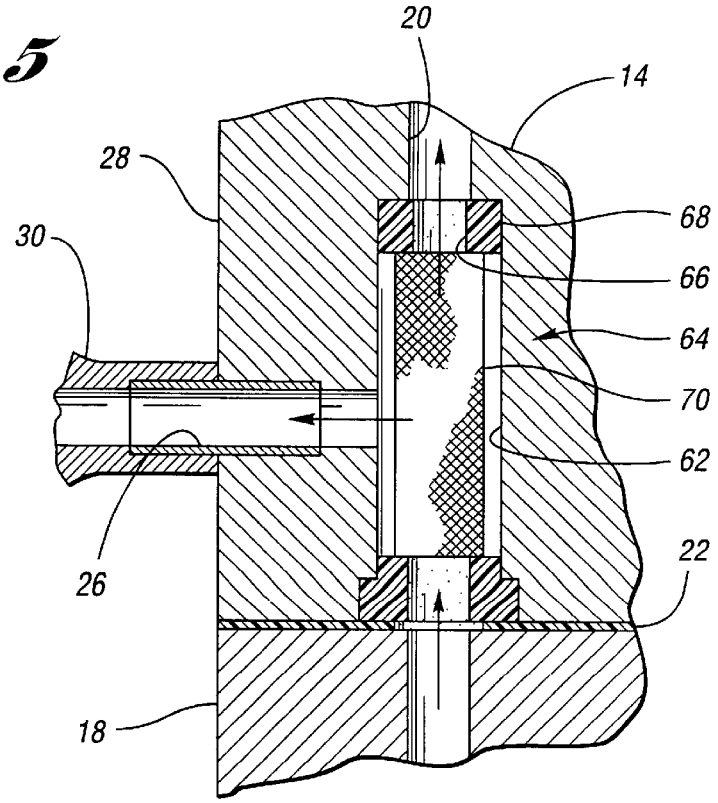
FIG. 5 is a partial cross-sectional view of an alternate cylinder head construction in accordance with the invention, illustrating an oil flow passage wherein an insert defines both a downstream flow restrictor and an upstream, in-line, radial-flow screen filter.

FIG. 5 shows a partial cross-sectional view of an alternate cylinder head construction for use with the invention, whereby a filter element is housed within the cylinder head 14 rather than within the oil flow control module 30. More specifically, as in the first exemplary system 12, the cylinder head 14 receives a flow of pressurized oil into a cavity 62 defined by a slightly enlarged section of the cylinder head's internal passage 20. In this alternate cylinder head construction, an insert 64 is received within the cavity 62 defined within the cylinder head 14. A reduced-diameter passage 66 in one end 68 of the insert 64 advantageously defines the downstream flow restrictor in the passage 20, while an intermediate (upstream) portion of the insert 64 includes an in-line, radial-flow screen filter 70. The screen filter 70, which is preferably of a "flow-through" design, operates to remove contaminants from oil diverted to the spool valve 38, with the screened contaminants otherwise "flowing through" the cylinder head's internal passage 20 to the engine's valve train. In this manner, the screen filter 70 housed within the cylinder head 14 in the alternate construction is beneficially rendered "self-cleaning."

Figure 6:
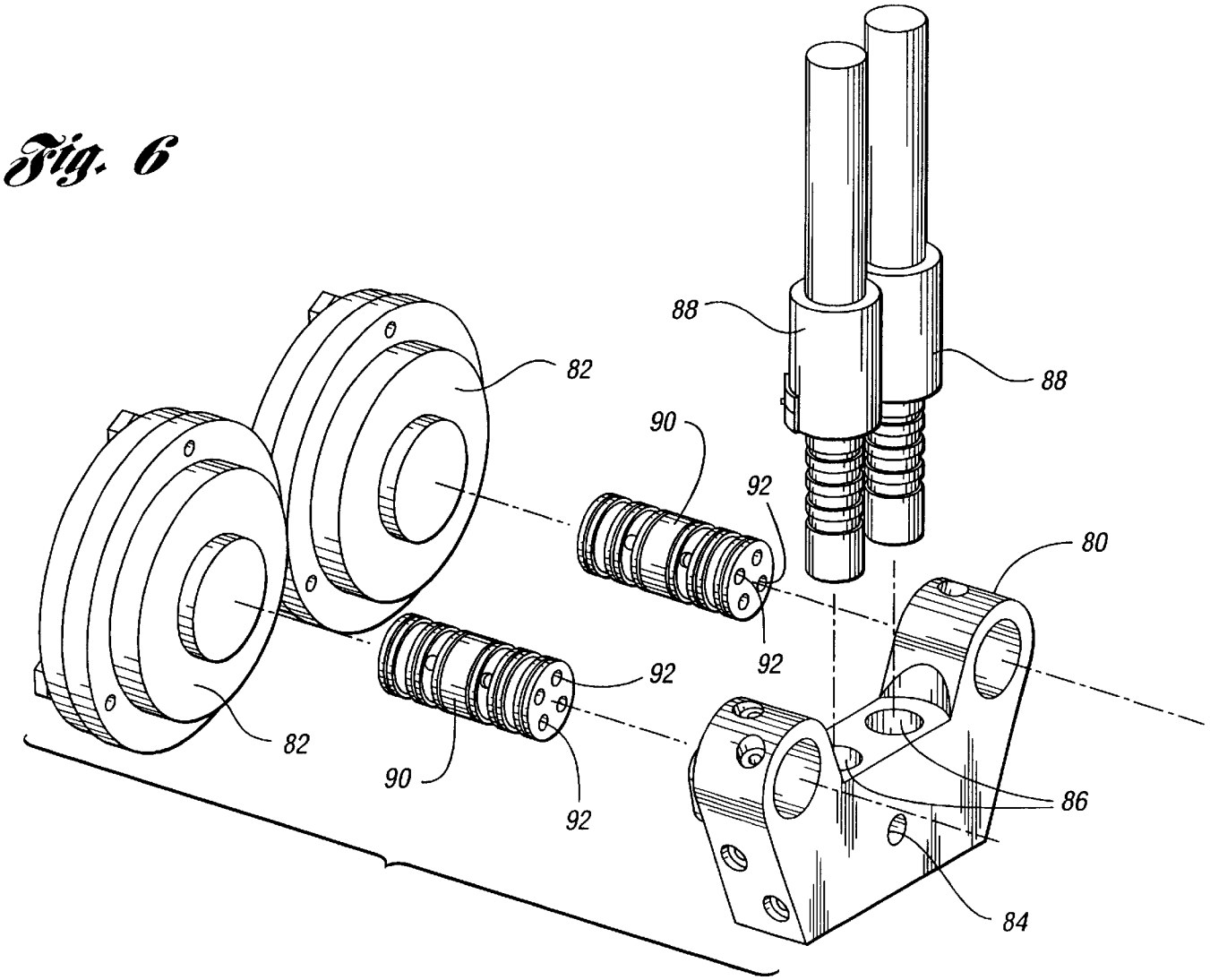
FIG. 6 is an exploded view in perspective of an alternate oil flow control module and associated cam phaser units for providing variable cam timing to both intake and exhaust valves of a given cylinder head, in accordance with the invention.

FIG. 6 is an exploded view in perspective of an alternate oil flow control module 80 and associated cam phaser units 82 for providing variable cam timing to both intake and exhaust valves of a given engine, in accordance with the invention. The module 80 includes an oil inlet 84 with which to receive unrestricted, preferably filtered, pressurized oil flow from its respective cylinder head (not shown); a pair of bores 86, in fluid communication with the oil inlet 84, that are arranged to receive each of two independently-operable spool valves 88; and a pair of feeder shafts 90, secured in a suitable manner to the camshaft for rotation therewith, in which a plurality of outlet passages 92 are defined that lead to the respective cam phaser unit 82.

While exemplary systems have been illustrated and described, it should be appreciated that the invention is susceptible of modification without departing from the spirit of the invention or the scope of the subjoined claims.

What is claimed is:

1. A system for controlling a flow of pressurized oil in an internal combustion engine, wherein the engine includes a cylinder block and a cylinder head, the system comprising:

a first internal passage defined within the cylinder head that receives a flow of pressurized oil from the cylinder block, wherein the first passage includes a flow restrictor at a first location therealong;

an oil outlet defined in an external surface of the cylinder head, the oil outlet being in fluid communication with a first section of the first passage upstream of the flow restrictor, whereby a first portion of the received flow of pressurized oil is urged to flow through the oil outlet; and an oil flow control module secured to the cylinder head, wherein the module includes an inlet passage receiving the first portion of the received flow, the module further including a plurality of outlet passages, and a control valve operative to direct the first portion of the received flow into a selected one of the outlet passages.

2. The system of claim 1, wherein the module is also secured to the cylinder block.

3. The system of claim 1, wherein the module includes an oil inlet defined in a first external surface of the module, the oil inlet being in fluid communication with the inlet passage; and wherein the oil outlet of the cylinder head and the oil inlet of the module cooperate to align the module on the cylinder head.

4. The system of claim 3, including a tubular dowel received in both the oil outlet of the cylinder head and the oil inlet of the module.

5. The system of claim 3, wherein the module includes a second external surface, and wherein the second external surface of the module defines at least a portion of a chain guide.

6. The system of claim 1, including a filter operative to remove particulate from the first portion of the received flow.

7. The system of claim 6, wherein the filter only removes particulate from the first portion of the received flow.

8. The system of claim 6, wherein the filter is disposed in the first passage of the cylinder head.

9. The system of claim 1, wherein the module further includes a cylindrical projection, the projection including a plurality of oil ports defined therein, each oil port being in fluid communication with a respective one of the outlet passages in the module.

10. An oil supply and control module for an internal combustion engine, wherein the engine includes a cylinder block and a cylinder head, the system comprising:

a first internal passage defined within the cylinder head that receives a flow of pressurized oil from the cylinder block, wherein the first passage includes a flow restrictor at a first location therealong;

an oil outlet defined in an external surface of the cylinder head, the oil outlet being in fluid communication with a first section of the first passage upstream of the flow restrictor, whereby a first portion of the received flow of pressurized oil is urged to flow through the oil outlet;

an oil flow control module respectively secured to the cylinder head and the cylinder block, wherein the module includes an inlet passage receiving the first portion of the received flow, the module further including a plurality of outlet passages, and a control valve operative to direct the first portion of the received flow into a selected one of the outlet passages; and a filter on one of the cylinder head and the module operative to remove particulate from the first portion of the received flow before the first portion of the received flow is directed by the control valve into the selected one of the outlet passages.

11. The system of claim 10, wherein the module includes an oil inlet defined in a first external surface of the module, the oil inlet being in fluid communication with the inlet passage; and wherein the oil outlet of the cylinder head and the oil inlet of the module cooperate to align the module on the cylinder head.

12. The system of claim 11, including a tubular dowel received in both the oil outlet of the cylinder head and the oil inlet of the module.

13. The system of claim 11, wherein the module includes a second external surface, and wherein the second external surface of the module defines at least a portion of a chain guide.

14. The system of claim 10, wherein the filter is disposed in the first passage upstream of the flow restrictor.

15. The system of claim 10, wherein the filter only removes particulate from the first portion of the received flow.

16. The system of claim 10, wherein the module further includes a cylindrical projection, the projection including a plurality of oil ports defined therein, each oil port being in fluid communication with a respective one of the outlet passages in the module.

17. The module of claim 10, wherein the restrictor is defined by a reduced-hydraulic-diameter section of the first passage.

* * * * *